United States Patent [19]

Schadow et al.

[11] 4,118,609

[45] Oct. 3, 1978

[54] ELECTRICAL SNAP-ACTION SWITCH

[75] Inventors: Rudolf Schadow; Klaus Hinze, both of Berlin, Germany

[73] Assignee: ITT Industries, Inc., New York, N.Y.

[21] Appl. No.: 715,395

[22] Filed: Aug. 18, 1976

[30] Foreign Application Priority Data

Aug. 26, 1975 [DE] Fed. Rep. of Germany ..... 2537905

[51] Int. Cl.[2] ..... H01H 5/18

[52] U.S. Cl. ..... 200/67 DA; 200/159 A

[58] Field of Search ..... 200/67 D, 67 DA, 67 DB, 200/159 R, 159 A, 5 A

[56] References Cited

U.S. PATENT DOCUMENTS

| | | | |
|---|---|---|---|
| 2,616,996 | 11/1952 | Beeman | 200/67 DA |
| 3,306,998 | 2/1967 | Russell | 200/67 DB |
| 3,800,104 | 3/1974 | Lien et al. | 200/67 DA |
| 4,046,982 | 9/1977 | Schadow et al. | 200/5 A |

*Primary Examiner*—Samuel W. Engle
*Assistant Examiner*—Ralph Palo
*Attorney, Agent, or Firm*—James B. Raden; William J. Michals

[57] ABSTRACT

A flat snap-action push-button switch comprising a sheetmetal spring with two elongated slots dividing the sheetmetal member into three coherent strips, is disclosed. The center strip is extended beyond the point of junction of the strips, and carries contacts which cooperate with fixed contacts on a printed circuit board. By depressing the center strip the spring snaps over thus opening one contact and closing another. The switch is particularly suited for use with key boards of electronic pocket calculators.

10 Claims, 5 Drawing Figures

ELECTRICAL SNAP-ACTION SWITCH

BACKGROUND OF THE INVENTION

The present invention relates to an electrical snap action switch comprising a sheetmetal member divided into several strips. The member is warped by reducing the length of at least one strip, with at least one such reduced strip being connected at both ends with a non-reduced strip, thereby serving as a bridge contact for establishing or interrupting an electrical connection between fixed contacts lying in one plane parallel in relation to the sheetmetal member.

The feature of arranging an electrical snap action switch comprising such a sheet metal member is known in the art. However, in these prior art devices there have been provided a switch-on device which is dependent upon the switching pressure, and whose possibilities of practical application are restricted. When providing a support according to the prior art, the snap action switch, when operated, will snap into a different plane from which it cannot be returned without providing further steps and measures. Accordingly, such a switch cannot be used as a pushbutton switch without the provision of additional means. Moreover, it is not to be seen how the switch-on device can be reconstructed to serve as a change-over device for operating contacts in one plane.

It is therefore the object of the invention to provide an electrical snap-action switch comprising a warped sheet metal member acting as the bridge contact, which is suitable for being optionally used as a switch-on or change-over contact, and which is also capable of being pushed. Moreover, the switch includes large contacting paths which are independent of the operating force, resulting in reliable switch positions; and the switch shall be capable of being assembled of a small number of simple-design parts requiring only a few manipulations.

SUMMARY OF THE INVENTION

With respect to an electrical snap action switch of the type mentioned hereinbefore, this object is achieved in that in the sheetmetal member the contacts are provided on at least one strip, that the sheetmetal member in the direction of the strips is extended beyond the web connecting the strips, in such a way that extensions with contact-making points are formed, and that the sheetmetal member is supported for swivelling about an axis thereof and within the area of the connecting web extended by the extensions.

The invention can be advantageously further embodied so that the sheetmetal member is arched on one side in one direction, in cases where the switch is to be used as a pushbutton switch and which is to snap back into one defined (arched) switch position. This is readily accomplished in that at least one strip is reduced in size by being arched on one side in the longitudinal direction.

A further advantage of the invention results in the fact that the sheetmetal member can be punched and bent in the course of one single operation. The sheetmetal member consisting of one piece is preferably punched out with rounded contours in such a way as not to cause any sharp-edged tearing points in the sheetmetal member which are likely to reduce the service life of the snapping sheetmetal member (spring).

Moreover, it is advantageous to support the sheetmetal member on a mask of frame-like design permitting the sheetmetal member to travel through the frame of the mask when performing the snapping operation.

BRIEF DESCRIPTION OF THE DRAWING

Further advantages and details of the invention will now be explained in greater detail with reference to the examples schematically shown in FIGS. 1–6 of the accompanying drawing, in which.

DETAILED DESCRIPTION

Figure 1:
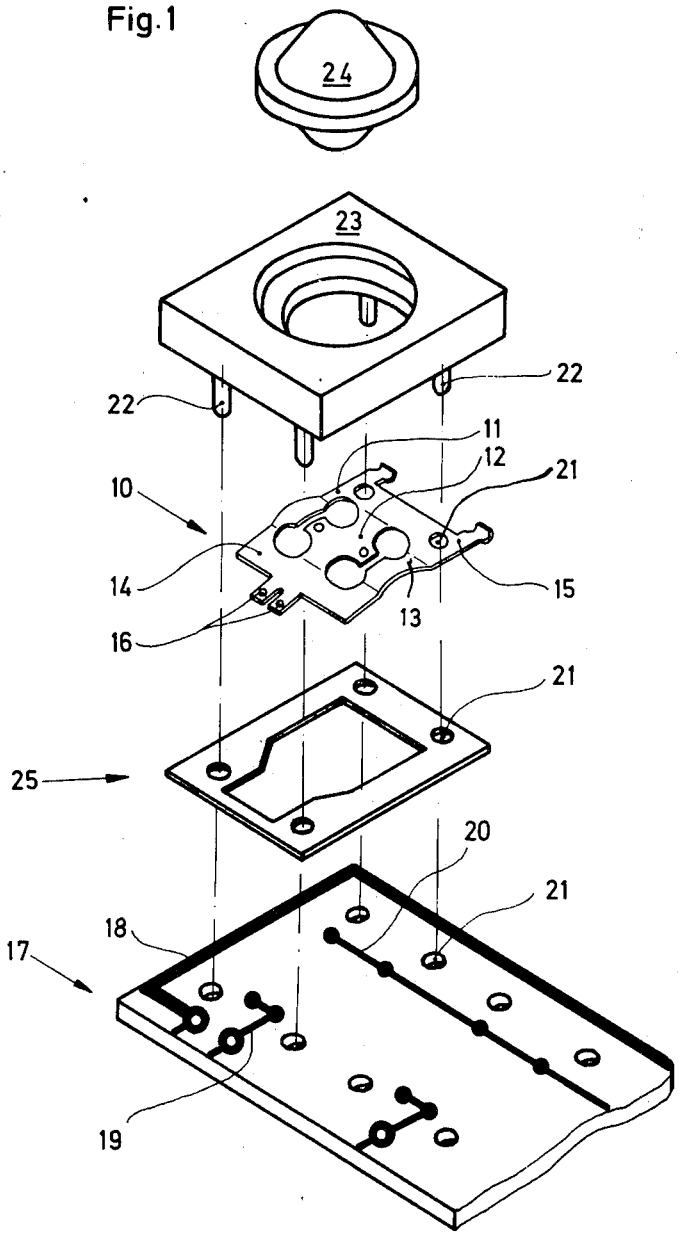
FIG. 1 in an exploded view, perspectively shows a novel type of snap-action switch with a frame arranged on a printed circuit board.

The major part of the electrical snap-action switch shown in FIG. 1, is the snapping sheetmetal member 10 consisting of the three strips 11, 12 and 13. The strips 11 and 13 have been reduced in size by an arching, in order thus to give the center strip 12 a spring force causing it to snap when acted upon by an applied pressure.

Moreover, the snap-action switch consists of a printed circuit (p.c.) board 17 comprising a pattern of printed conductors 18, 19 and 20. The snapping sheetmetal member 10 is now placed on to the p.c. board in such a way as to establish an electrical connection between the printed conductors 18 and 19 in that on the snapping sheetmetal member, the contacts 16 will come to lie on corresponding parts of the printed conductors. Moreover, the snapping sheetmetal member may be attached to one printed conductor 18 with the aid of further extensions.

When exerting pressure upon the arched portion of the strip 12, the sheetmetal member 10 is caused to snap in such a way that the contacts 16 are lifted off the p.c. board, thus interrupting the electrical connection between the printed conductors 18 and 19. The thus pushed-through strip 12 will now, in turn, come to lie on the printed conductor 20 so as to establish an elecrical connection between the printed conductor 18 (via the sheetmetal member 10) and the printed conductor 20. Accordingly, the snapping sheetmetal member acts as a snap-action bridge contact interrupting the connection between the conductors 18 and 19 before establishing the connection between the conductors 18 and 20.

For effecting the snapping operation, the strip 12 must swing through a center position and, therefore, requires a support on the p.c. board which, in FIG. 1, is represented by a frame 25. This frame 25 can be secured with the aid of holes 21 and corresponding pins 22 between the snapping sheetmetal member 10 and the p.c. board 17.

The strips of the snapping sheetmetal member 10 are joined to one another by means of connecting webs (cross-pieces) 14 and 15, thus enabling the mutual warping thereof. The connecting web 14, moreover, carries the contacts 16 in the form of extensions in the same direction as the strips. It should now be appreciated that the sheetmetal member can be punched and shaped in one piece or of a one-piece construction as shown in the drawing. The warping and bending may be produced simultaneously in the course of punching the sheetmetal member. The rounded corners of the outer contour prevent a tearing of the sheetmetal material.

The contacts of the extensions 16 and on the center strip 12 are arranged on different sides of the connecting web 14. Moreover, the connecting web rests in such a way on portions of the frame 25 as to form an axis of rotation during the snapping operation, about which the different contacts 16 and 12 are permitted to turn as around a two-armed lever.

Furthermore, the snapping sheetmetal member 10 may have a monostable design thus causing the sheetmetal member without any actuating forces, to assume always one position. This is accomplished, for example, in that the reduction in size of the strip 11 and 13 is simultaneously combined with an arching of the entire sheetmetal member in direction of the shortening. For permitting the sheetmetal member to remain in this single-sided arched position, the spring material to be used should be as rigid as possible.

A bending-through (deflection) of the strip 12 in connection with a rotary movement of the connecting webs 14 or 15 may still be influenced by a dimensioning of the shape of the sheetmetal member, i.e., in that the length of the strips is not made substantially greater than the length of the connecting webs 14 and 15. Accordingly, a small reduction in size (shortening) of the strips 11 and 13 will only cause a very weak snapping or deflection of the strip 12 which is absorbed again by the resetting forces of the connecting webs 14 and 15. When designed in such a way, the snapping sheetmetal member is preferably suitable for use in a pushbutton switch.

Moreover, it has been found that the points of application of the pushbutton force can be situated within a wide range of the sheetmetal member. Therefore, of the various embodiments, where only one pushbutton 24 is shown, it is also possible to use other pushbuttons acting within the range of the strip 12.

Figure 2:
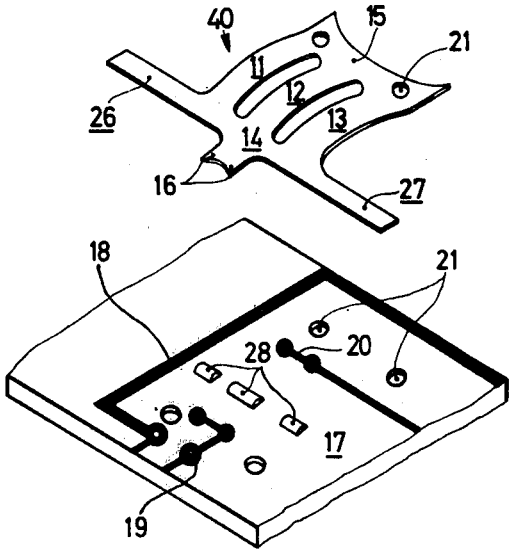
FIG. 2 shows a modified embodiment of the snap-action switch comprising a similarly designed snapping sheetmetal member, and illustrating the particularities of the supporting means on the printed circuit board.

Another embodiment of the novel pushbutton switch is illustrated in FIG. 2 of the drawing in which, however, there are only shown those parts which are necessary for a proper understanding of the invention. The sheetmetal member 40 is shown to have extensions 26 and 27 which differ with regard to shape and size, and which represent a further embodiment of the holding arrangement of the rotatable web 14. It is also not necessary to provide a frame as the support, because raised portions 28 are provided for in the printed circuit board 17, serving to lift the sheetmetal member 40 in such a way off the p.c. board, as to permit it to swing or snap through the free space lying therebetween, in order to perform the switching functions.

Figure 3:
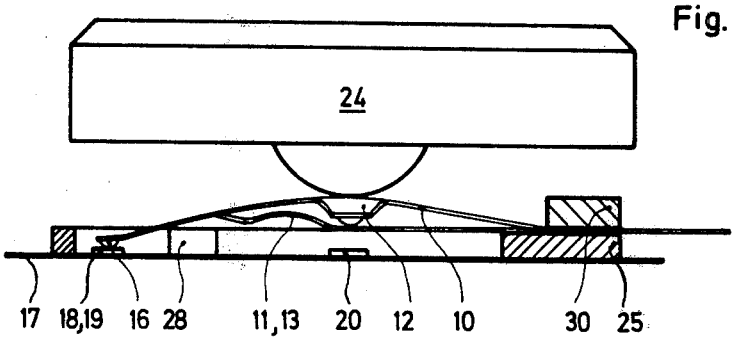
FIGS. 3 and 4 illustrate sideviews of the novel snap-action switch in the initial and operated positions; and, FIG. 5 shows a pushbutton assembly comprising a plurality of snapping sheetmetal members of a one-piece construction.
Figure 4:
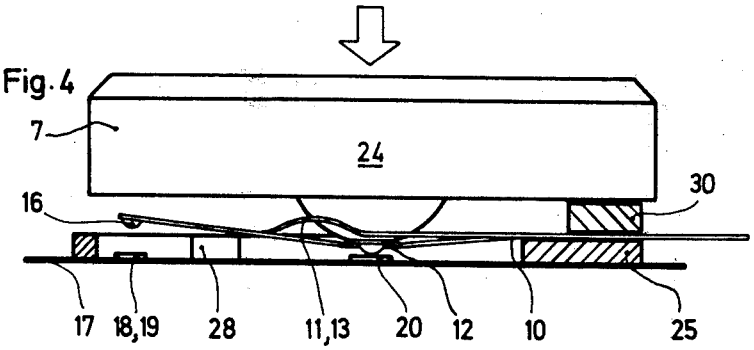

FIGS. 3 and 4 show corresponding sectional side views of the novel pushbutton switch. Identical parts of this pushbutton switch are indicated by the same reference numerals. The sectional views show a pushbutton switch in two different switch positions, and illustrate that the snapping sheetmetal member 10 swivels the contacts 16 and 12 about the connecting web 14 as in the case of a two-armed lever. It is of no particular importance in this respect whether as the support of the slewable connecting web 14, there is provided a portion of the frame 25, or the other supporting means 28 (FIG. 2) which may be arranged in the p.c. board 17 itself. As such a support it is also possible to use impressed (embossed) projections or chambered (bevelled) portions provided for on the extended webs (legs) 26 and 27.

The snapping sheetmetal member 10 may be clamped on one side with the aid of hold members 30. It is also possible, however, to use a different type of embodiment of the sheetmetal member as is indicated by way of example, in FIG. 2 by the extensions 26 and 27, thus permitting a sheetmetal member which is self-supported on two sides, to perform switching functions on both sides. This simultaneously secures the swivel axis of the sheetmetal member.

Figure 5:
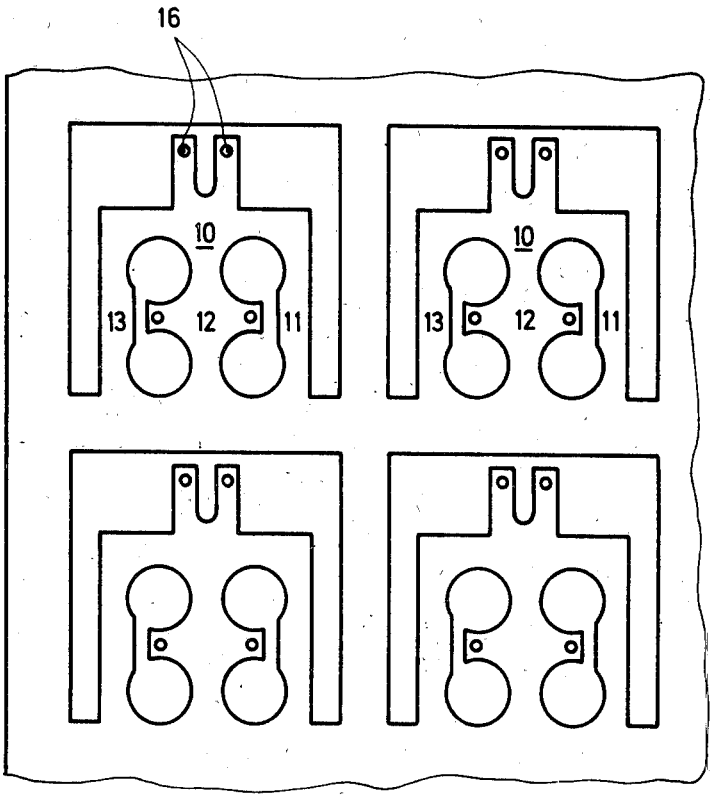

In further embodying the invention it is proposed to use a continuous sheetmetal strip comprising several snap-action contacts, as is shown in FIG. 5. With such a sheetmetal strip the pushbutton switch according to the invention may be combined to form a pushbutton assembly in which a system of the snapping sheetmetal members is punched out of one piece, and bend accordingly. This is of advantage especially in cases where it is necessary to provide a printed circuit board with many switching possibilities, which may also be manufactured in one piece serving several pushbutton switches in common.

FIGS. 1 and 2 show the design layout of a printed circuit board serving one or two pushbutton switches. It is also conceivable, however, to combine both the pushbutton switch and the change-over switch on the same printed circuit board.

What is claimed is:

1. An electrical snap-action switch comprising a sheetmetal member divided into a plurality of strips connected at the end portions thereof by a web, which member is warped by reducing the length of at least one strip thereof, with at least one such reduced strip being connected at both ends with a non-reduced strip, serving as a bridge contact for establishing or interrupting an electrical connection between fixed contacts lying in a plane parallel to the sheetmetal member, wherein the contacts of the sheetmetal member are provided on at least one strip of the sheetmetal member which is extended in the direction of the strips beyond the web connecting the strips, so that extensions with contact-making points are formed, and means supporting said sheetmetal member for swiveling the extensions which carry the contact-making points of said member about an axis which is within the area of the connecting web extended by the extensions.

2. The electrical snap-action switch according to claim 1, wherein said sheetmetal member is arched on one side thereof in at least one direction.

3. An electrical snap-action switch according to claim 2, wherein at least one of said strips is reduced in size by being arched on one side in the longitudinal direction.

4. The electrical snap-action switch according to claim 3, wherein an actuating member is provided by which forces are exerted upon at least one of said strips, with contacts being attached to this strip.

5. The electrical snap-action switch according to claim 1, wherein the sheetmetal member together with the extensions are of an integral one-piece construction.

6. The electrical snap-action switch according to claim 1, wherein the length of the strips are not substantially greater than the length of the connecting webs.

7. The electrical snap-action switch according to claim 1, wherein a frame is provided for supporting said member and facilitating the swivelling thereof.

8. The electrical snap-action switch according to claim 1, wherein said strips are produced by being punched out of sheetmetal material.

9. The electrical snap-action switch according to claim 8, wherein the ends of the strip are punched to provide arcuate rounded edges.

10. The electrical snap-action switch according to claim 9, wherein the slots between said strips consist of circular holes provided with a connecting gap.

* * * * *